US006921577B2

(12) United States Patent
Ouchi et al.

(10) Patent No.: US 6,921,577 B2
(45) Date of Patent: Jul. 26, 2005

(54) WATER-BASED METAL SURFACE TREATMENT AGENT

(75) Inventors: Takashi Ouchi, Kitaibaraki (JP); Katsuyuki Tsuchida, Kitaibaraki (JP); Masashi Kumagai, Hitachi (JP)

(73) Assignee: Nikko Materials Co., Ltd., Tokyo (JP)

( * ) Notice: Subject to any disclaimer, the term of this patent is extended or adjusted under 35 U.S.C. 154(b) by 404 days.

(21) Appl. No.: 10/169,893

(22) PCT Filed: Feb. 19, 2002

(86) PCT No.: PCT/JP02/01427

§ 371 (c)(1),
(2), (4) Date: Jul. 8, 2002

(87) PCT Pub. No.: WO02/090616

PCT Pub. Date: Nov. 14, 2002

(65) Prior Publication Data

US 2003/0017343 A1 Jan. 23, 2003

(30) Foreign Application Priority Data

Apr. 24, 2001 (JP) ..... 2001-125206

(51) Int. Cl.[7] ..... B32B 15/08

(52) U.S. Cl. ..... 428/418; 428/413; 523/402; 523/406; 148/22

(58) Field of Search ..... 523/402, 406; 428/413, 418; 148/22

(56) References Cited

FOREIGN PATENT DOCUMENTS

| | | |
|---|---|---|
| JP | H03-192166 | 8/1991 |
| JP | H05-148447 | 6/1993 |
| JP | H05-222324 | 8/1993 |
| JP | H09-176285 | 7/1997 |
| JP | 2001-039927 | 2/2001 |
| JP | 2001-316835 | 11/2001 |

OTHER PUBLICATIONS

Machine Translation, JP 2001–316835, Tsuchida et al., Nov. 16, 2001.*

"Hyomen Gijutsu" ('Surface Technology'), 49(3), 221 (1998) with English abstract.

* cited by examiner

*Primary Examiner*—Randy Golakowski
*Assistant Examiner*—Christopher Keehan
(74) *Attorney, Agent, or Firm*—Flynn, Thiel, Boutell & Tanis, P.C.

(57) ABSTRACT

A water-based metal surface treatment agent for the surface treatment of metals including aluminum products such as pre-coated aluminum sheets gives excellent coating film adhesion, flexibility and acid resistance.

The water-based metal surface treatment agent contains the following components (1) to (3):

(1) A copolymer, containing in a side chain, a diketene or ketoester capable of switching between keto and enol tautomeric forms, and containing at least one hydrophilic side chain containing a cationic group, an anionic group, or a nonionic group;
(2) An epoxy resin modified with a phosphoric acid type compound; and
(3) A water-soluble curing agent.

8 Claims, No Drawings

WATER-BASED METAL SURFACE TREATMENT AGENT

BACKGROUND OF THE INVENTION

1. Field of the Invention

The present invention relates to a surface treatment agent which is possible to make a metal surface rust-proofing and to improve the coating film adhesion, and in particular to a metal surface treatment agent suitable for use with aluminum products such as pre-coated aluminum sheets.

2. Description of the Related Art

Metal surfaces have been treated conventionally to improve the corrosion resistance of the metal surfaces, with a number of/types of metal surface treatment agents being used. Of the various types of metal surface treatments, chromate treatment using a compound containing chromic acid is commonly used, since chromate treatment gives metal an excellent corrosion resistance and also exhibits good properties in terms of adhesion to paints.

However, it has been pointed out that the chromium used in chromate treatment causes environmental pollution, and hence in recent years alternative metal surface treatment methods and surface treatment agents have been developed. Materials of such surface treatment agents include tannic acid, organophosphorus compounds, silane type coatings, and surfactants, as disclosed in Hyomen Gijutsu ('Surface Technology'), 49 (3), 221 (1998). Moreover, a surface treatment agent obtained by copolymerizing an unsaturated carboxylic acid (Japanese Patent Publication No. H5-222324) and a surface treatment agent that is a copolymer of a glycidyl-group-containing unsaturated monomer and and acrylic acid ester (Japanese Patent Publication No. H3-192166) are known. These materials all use ank acrylic type resin and, to achieve sufficient corrosion resistability, the coating film must be made thick. Moreover, the adhesion of these materials to various metals such as iron and aluminum is not always adequate, and in a wet environment the adhesion may drop markedly resulting in the coating film peeling off. Epoxy resin type materials, on the other hand, give improved adhesion to the substrate. For example, a water-soluble coating composition comprising water and an alkali-neutralized reaction product of the reaction between a phosphoric acid containing P-OH bonds, an epoxy resin and a glycidyl (meth)acrylate (Japanese Patent Publication No. H5-148447), and an epoxy resin composition comprising a polyglycidyl compound and a phosphoric acid ester containing P-OH bonds obtained from a phosphoric acid and a monoglycidyl ether or ester compound (Japanes,e Patent Publication No. H9-176285), have been proposed. However, although these materials give good adhesion, it is necessary to make the coating film thick to improve the corrosion resistability.

In contrast with the above, in Japanese Patent Publication No. 2001-39927, the present inventors disclosed a novel tricarbonyl compound, a novel tricarbonyl group-containg acrylic copolymer, and a metal surface treatment agent using the same, as a surface treatment agent that adheres strongly to a metal surface and gives excellent corrosion resistance and corrosion resistability, even in the case of a thin film. Furthermore, in Japanese Patent Publication No. 2001-316835, the present inventors disclosed a metal surface treatment agent in which an epoxy ester reaction mixture between a phosphoric acid type compound and an epox yesin is associated with a silane compound or a titanium compound.

However, although the metal surface treatment agents according to the prior art described above give excellent corrosion resistability and are suited to applications in which this treatment is the finishing process (for example an automobile evaporator), application to so-called pre-coated aluminum sheets, i.e. aluminum plates further coated with a polyester, a fluororesin, an epoxy resin or the like, is difficult. In the case of aluminum plates used in automobile evaporators, corrosion resistability is required first of all, and coating film adhesion is not required that much. With pre-coated aluminum sheets, on the other hand, the surface is painted, and hence various properties are required of the aluminum plate after the painting. Specifically, not to mention the corrosion resistability of a painted aluminum plate, the user may use the aluminum plate after bending, and hence coating film adhesion, flexibility and ease of bending are important. In addition, with surface treatment agents applied to pre-coated aluminum sheets, there are calls to move from organic solvents to water-based solvents.

Furthermore, depending on the usage environment, surface treatment agents applied to pre-coated aluminum sheets may be required to give the pre-coated aluminum sheet surface acid resistance.

SUMMARY OF THE INVENTION

It is thus an object of the present invention to provide a water-based metal surface treatment agent that forms a coating film having excellent corrosion resistability, coating film adhesion and flexibility, and can be used with various types of metal surfaces, including pre-coated aluminum sheets.

The present inventors studied assiduously, and as a result discovered that a water-based metal surface treatment agent having the following (1) to (3) as essential components is effective for attaining the above object.

(1) A copolymer containing in a side chain a diketene or ketoester capable of switching between keto and enol tautomeric forms and also containing at least one hydrophilic side chain containing a cationic group, an anionic group or a nonionic group.

(2) An epoxy resin modified with a phosphoric acid type compound.

(3) A water-soluble curing agent.

In particular, the copolymer used in the water-based metal surface treatment agent of the present invention preferably contains a compound represented by undermentioned structural formula (I) as one of the monomers thereof.

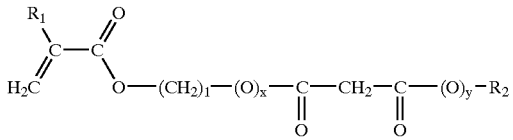

(I)

In formula (I), $R_1$ is a hydrogen atom or a methyl group, $R_2$ is a $C_{2-10}$ alkenyl group having a double bond at the end thereof or a $C_{1-10}$ alkyl group, 1 is 1 to 3, and x and y are independently each 0 or 1. Note, however, that the compound is shown only in the keto form above, but the compound may also exist as an enol tautomeric form as shown below; the enol form is also deemed to be included in the present invention.

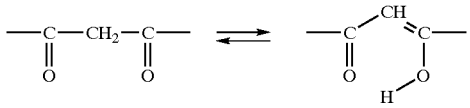

Keto form Enol form

Examples of unsaturated monomers which form the copolymer with a compound represented by above-mentioned formula (I) include alkyl acrylates such as methyl acrylate and isopropyl acrylate, hydroxyethyl acrylate, polyethylene glycol acrylate, dimethylaminoethyl acrylate, glycidyl acrylate, 2-cyano acrylate, benzyl acrylate, phenoxyethyl acrylate, tetrahydrofuryl acrylate, dicyclopentenyloxy acrylate, fluoroacrylates, sulfopropyl acrylate, β-ethoxyethyl acrylate, γ-acryloxypropylalkoxysilanes and methacrylates thereof, and unsaturated-bond-containing carboxylic acids such as acrylic acid and methacrylic acid. However, to make the copolymer water-soluble, a side chain containing at least one cationic group such as an amino group, an imino group, a tertiary amine group, a quaternary ammonium salt group or a hydrazine group, anionic group such as a carboxyl group, a sulfone group, a sulfate ester group or a phosphate ester group, or npnionic group such as a hydroxyl group, an ether group or an acido group is necessary. Moreover, 4-vinylphenyltrimethoxysilane or the like can also be used as the above-mentioned unsaturated monomer. Moreover, examples of unsaturated monomers having an alkoxysilyl group such as the above-mentioned γ-acryloxypropylalkoxysilanes include γ-acryloxypropyltrimethoxysilane, γ-acryloxypropyl- methyldimethoxysilane and methacryloxy derivatives thereof, and 4-vinylphenyltrimethoxysilane. Furthermore, styrene compounds such as 4-chlorostyrene and pentafluorostyrene can also be preferably used. Moreover, it is possible to use a plurality of these materials together.

An organic peroxide, an organic azo compound, or a persulfate can be used as a radical polymerization initiator when forming the polymer or copolymer. Preferable examples of organic peroxides include benzoyl peroxide and t-butyl peroxypivalate. Preferable examples of organic azo compounds include 2,2'-azobisisobutyronitrile and 2,2'-azobis(2,4-dimethylvaleronitrile).

As exemplified by the undermentioned general formula, the copolymer of the present invention can be obtained as a substantially linear structure. In the case that R2 in general formula (I) is an alkenyl group, a hardenable copolymer is obtained having a structure in which the alkenyl groups hang down. After being applied onto the metal surface, such a copolymer can be crosslinked and thus cured by heat, ultraviolet rays, or a curing catalyst or curing agent. The molecular weight of the linear copolymer of the present invention, although not being particularly limited, should be about 1,000 to 1,000,000, preferably 5,000 to 200,000.

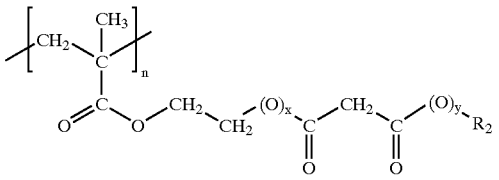

In addition to the copolymer described above, the metal surface treatment agent of the present invention also has as essential components an epoxy resin modified with a phosphoric acid type compound, and a water-soluble curing agent.

The epoxy resin modified with a phosphoric acid type compound can be obtained by an epoxy ester reaction of a phosphoric acid type compound and an epoxy resgin.

Here, phosphoric acid, phosphorous acid, or hypophosphorous acid, or an ester thereof is preferable as the phosphoric acid type compound; in the case of the ester, a lower alkyl monophosphate ester is preferable.

Moreover, there are no particular limitations on the epoxy resin reacted with the phosphoric acid type compound but, for example, a a bisphenol type epoxy resin synthesized using bisphenol A or the like is preferable.

The phosphoric acid type compound and the epoxy resin is reacted such that there are 0.5 to 4.0 equivalents of P-OH groups in the phosphoric acid type compound per 1 equivalent of epoxy groups. It is preferable for the reaction to proceed at a reaction temperature of 60 to 1500C. Moreover, the reaction can be carried out in a solvent. Examples of solvents that can be used include alcohol solvents such as ethylene glycol propylene glycol and methylpropylene gycol, and ether compounds thereof, ethyl acetate, butyl acetate, cellosolve acetate, methyl ethyl ketone, dimethylformamide, and dioxane. After the reaction has been completed, water is added to the reaction mixture to obtain an aqueous solution. Moreover, it is also possible to treat the mixture with an alkali to neutralize active hydrogen groups in the product.

Examples of alkalis that can be used include ammonia, dimethylamine, diethylamine, methylamine, ethylamine, trimethylamine, triethylamine and dimethylaminoethanolamine. It is preferable for the amount of the alkali used to be 0.8 to 1.5 equivalents per 1 equivalent of active hydrogens in the resin.

There are no particular limitations on the water-soluble curing agent, but examples include melamine resins and blocked isocyanate resins.

A water-soluble resin may be included in the metal surface treatment agent of the present invention. A water-soluble resin contributes to improving the film formation ability of the surface treatment agent, and further improves the corrosion resistance of the surface coating film. Examples of such a water-soluble resin include polyvinyl alcohol, saponified polyvinyl acetate, cellulose, alkyd resins, polyester resins, polyethylene glycol, epoxy resins, acrylic resins, urethane resins, and acrylic silicones.

A preferable composition of the metal surface treatment agent of the, present invention is 10 to 50, preferably 20 to 40,, parts by weight of the phosphoric acid-modified epoxy resin, 30 to 70, preferably 40 to 60 parts by weight of an acrylic dicarbonyl copolymer, and 5 to 40, preferably 10 to 30, parts by weight of the water-soluble curing agent, where the treatment agent is 100 parts by weight in total.

Additives such as viscosity regulators, antifoaming agents, ultraviolet absorbers, preservatives, surfactants and the like may also be used in the metal surface treatment agent of the present invention.

A publicly known application method can be used for applying the metal surface treatment agent of the present invention onto a metal surface, for example spray coating, dip coating, brush application, roll coating or spin coating.

To further improve the corrosion resistability of a metallic material using the metal surface treatment agent of the present invention, it is preferable to dry by heating after applying the treatment agent. This drying by heating is preferably continued for 30 seconds to 60 minutes at 100 to 230° C. The thickness of the coating film after the drying is preferably 0.1 to 100 μm, more preferably 0.5 to 10 μm. If this thickness is less than 0.1 μm then it will not be possible to obtain sufficient corrosion resistability, whereas if this thickness is greater than 100 μm then it will not obtain a uniform coating film.

DESCRIPTION OF THE PREFERRED EMBODIMENTS

Following is a detailed description of the water-based metal surface treatment agent of the present invention through examples and comparative examples.

Example 1

In the present example, firstly the phosphoric acid-modified epoxy resin and the acrylic dicarbonyl copolymer used in the water-based metal treatment agent of the present invention were synthesized. Next, the metal surface treatment agent was prepared using the phosphoric acid-modified epoxy resin and the acrylic dicarbonyl copolymer, and a surface of an aluminum plate was treated with the agent. Finally, a description will be given of the method of evaluating the metal surface after the treatment and the results of the evaluation.

(1) Synthesis of Phosphoric Acid-modified Epoxy Resin 42.85g of 85% phosphoric acid and 33.8g of methylpropylene glycol were put ,into a 3-mouth 1 l flask, this solution was agitated, and nitrogen gas was purged into the flask for 30 minutes The phosphoric acid solution was then heated to 120° C, and then a solution prepared by dissolving 141.25g of an epoxy resin (Epikoto 828 made by, Yuka Sheru Epokishi) in 24.95g of methylpropylene glycol was instilled into the phosphoric acid solution over 60 minutes under the nitrogen atmosphere. After completing the instillation, the materials were reacted for 30 minutes at the same temperature (120° C.). 31.7g of ion-exchange water was then instilled in and the reaction was continued for a further 2 hours. The solution was then cooled to 70° C. and 83.8g of triethylamine was added and reacted for 15 minutes. Next, the reaction solution was cooled to room temperature, and 1482.65g of ion-exchanged water was added, thus obtaining a 10 wt % phosphoric acid-modified epoxy resin aqueous solution.

(2) Synthesis of Acrylic Dicarbonyl Copolymer 6 g of methyl methacrylate, 14.22g of isobutyl methacrylate, 1.56g of styrene, 6.70g of methacrylic acid, 5.21g of hydroxyethyl methacrylate, 20.95g of acetoacetoxyethyl methacrylate, 0.66 g of 2,2-azoisobutyronitrile, 55.30g of methylpropylene glycol and 304.70g of isopropanol were put into a 3-mouth flask, and nitrogen gas was purged into the flask for 30 minutes. The reaction vessel was then heated in an oil bath, and the materials were agitated for 4 hours at 85° C. under a nitrogen atmosphere to polymerize. Next, the isopropanol was removed from the obtained polymer solution. 1.75 g of triethylamine was then added, the solution was agitated and then 426.65 g of ion-exchanged water was added, thus obtaining a 10 wt % acrylic dicarbonyl copolymer aqueous solution.

(3) Preparation of Metal Surface Treatment Agent

The phosphotic acid-modified epoxy resin synthesized in (1) above, a melamine resin (Saimeru 350 made by Mitsui Saitekku, diluted with pure water to make a solution having a nonvolatile content of 10 wt %) and the acrylic dpicarbonyl copolymer synthesized in (2) above were mixed together in the proportions by mass shown in Table 1 below, thus preparing a surface treatment agent. Note that Table 1 also shows the component proportions for Comparative Examples 1 and 2 described below.

TABLE 1

Proportions by mass of components of surface treatment agent

| Component | Example 1 | Comparative Example 2 | Comparative Example 1 |
|---|---|---|---|
| Phosphoric-acid-modified epoxy resin | 3 | 3 | — |
| Water-soluble curing agent | 2 | 2 | 2 |
| Acrylic dicarbonyl copolymer | 5 | — | 5 |

(4) Surface Treatment of Aluminum Plate

The surface treatment agent prepared in (3) was applied onto an aluminum plate (A1050P, 55×55×0.6mm, made by Kobe Seiko) using a spin coating method. The plate was heated for 10 minutes at 220° C., thus producing a test substrate. The thickness of the surface treatment coating film after the drying was about 1 μm.

(5) Evaluation of Test Substrate

1) Evaluation of Corrosion Resistability

The test substrate produced in (4) was subjected to a saltwater spray test as stipulated in JIS-Z-2371, and the corrosion resistability was evaluated by visual inspection. The test time was 168 hours. There were 3 evaluation levels as follows, and the evaluation results are shown later in Table 2.

○: Virtually no rusting

Δ: Pitting in places

X: Corrosion over whole surface

2) Evaluation as a Coating Film Foundation (Primer)

A polyester paint was applied by spin coating onto the surface treatment coating film on the test substrate produced in (4). The substrate was then heated for 5 minutes at 245° C. The thickness of the polyester paint film formed on the test substrate was about 15 μm. Using this test substrate, coating film adhesion, flexibility and acid resistance were tested as described below. The test results are shown later in Table 3.

(a) Paint Film Adhesion

The test substrate was immersed in boiling water for 5 hours, and then a checkerboard tape peeling test was performed as stipulated in JIS-K-5400. There were 3 evaluation levels as follows, with evaluating by visual inspection.

○:No peeling

Δ: Slight peeling seen at intersections in checkerboard pattern

X: Peeling over whole surface (b) Flexibility

Using a bending test apparatus as stipulated in JIS-K-5400, the test substrate was first bent to the 180° graduation mark under conditions of a mandrel diameter of 3mm and an auxiliary plate thickness of 3.5mm. The test substrate was then immersed in boiling water for 5 hours, and then the bent part of the test substrate was visually observed. There were 3 evaluation levels as follows.

○: No cracking at bent part

Δ: Slight cracking seen at bent part

X: Paint film peeled away from bent part (c) Acid Resistance

Cross cuts were put in close to the center of the test substrate using a cutter, the test substrate was immersed for 24 hours in a 5w/v % sulfuric acid solution, and then a tape peeling test was carried out on the cross cut part. There were 3 evaluation levels as follows, with evaluating by visual inspection.

○: No peeling
Δ: Slight peeling seen at intersections of cross cuts
X: Peeling over whole surface Example 2

A solution was prepared by weighing out the components used in Example 1 in the prescribed amounts and then dissolving in pure water and diluting such that the solid content became 20%. Then the solution was applied by spin coatin onto a zinc-plated steel plate (Jinkoto nonkurometohin, 60×80×0.6mm, made by Shin Nippon Seitetsu). The plate was then heated for 10 minutes at 220° C., thus producing a test substrate, and then a pencil cratching test was carried out as stipulated JIS-K-5400. The result was that the pencil hardness was above 5H. Note that the thickness of the surface treatment film was about 3 μm.

Comparative Examples 1 and 2

In Comparative Example 1, a metal surface treatment agent was prepared having a composition as in Example 1 but without the acrylic dicarbonyl copolymer. Moreover, in Comparative Example 2, a metal surface treatment agent was prepared having a composition as in Example 1 but without the phosphoric acid-modified epoxy resin.

Using these metal surface treatment agents, aluminum test substrates were produced as in Example 1, and evaluated. The evaluation results are shown later in Tables 2 and 3.

Comparative Example 3 (Comparison 1 with Chromate Treatment)

Chromic phosphate treatment (using Arusafu 407-47, made by Nippon Peinto, chemical conversion coating film chrome amount approx. 20mg/m$^2$) was carried out as foundation treatment on an aluminum substrate (A1050P, 55×55×0.6mm, made by Kobe Seiko). The substrate was then subjected to the same saltwater spray test as in Example 1.

Moreover, an epoxy resin type primer was applied by spin coating onto the chromic phosphate-treated aluminum substrate, and then the substrate was heated for 5 minutes at 245° C. The film thickness of the primer was about 5 μm. As a topcoat, a polyester resin was then applied by spin coating onto the aluminum substrate, and then the substrate was heated for 5 minutes at 245° C. The film thickness of the topcoat was about 15 μm. The resulting substrate was subjected to evaluations as a coating film foundation as in Example 1.

Comparative Example 4 (Comparison 2 with Chromate Treatment)

A polyester resin as a topcoat was applied by spin coating directly onto a chromic phosphate-treated aluminum substrate produced as in Comparative Example 3 without applying a primer first, and then the substrate was heated for 5 minutes at 245° C. The film thickness of the topcoat was about 15 μm. The resulting substrate was subjected to evaluations as a coating film foundation as in Example 1.

TABLE 2

Corrosion resistability evaluation results

| | |
|---|---|
| Example 1 | ○ |
| Comparative Example 1 | Δ |
| Comparative Example 2 | x |
| Comparative Example 3 | ○ |

TABLE 3

Coating film adhesion, flexibility and acid resistance evaluation results

| | Coating film adhesion | Flexibility | Acid resistance |
|---|---|---|---|
| Example 1 | ○ | ○ | ○ |
| Comparative Example 1 | x | x | x |
| Comparative Example 2 | x | x | x |
| Comparative Example 3 | Δ | Δ | ○ |
| Comparative Example 4 | x | x | x |

As can be seen from Tables 2 and 3, the test substrate surface treated using the surface treatment agent of the present invention showed excellent results in terms of all of the properties of corrosion resistibilty, coating film adhesion, flexibility and acid resistance.

If the water-based metal surface treatment agent of the present invention is used, then an excellent corrosion resistability effect is exhibited after the surface treatment, even though chrome, which causes environmental pollution is not used. Moreover, the water-based metal treatment agent of the present invention does not contain silane compounds, and hence the metal surface coating film formed has excellent acid resistance. In addition, the metal surface coating film has excellent coating film adhesion and flexibility. The water-based metal surface treatment agent of the present invention is thus suitable for use with aluminum products such as pre-coated aluminum sheets.

What is claimed is:

1. A water-based metal surface treatment agent comprising components (1) to (3):

(1) a copolymer, containing in a side chain a diketene or ketoester capable of switching between keto and enol tautomeric forms, and containing at least one hydrophilic side chain containing a cationic group, an anionic group or a nonionic group;

(2) an epoxy resin modified with a phosphoric acid type compound; and (3) a water-soluble curing agent.

2. The water-based metal surface treatment agent according to claim 1, at least one monomer of the copolymer of (1) being a dicarbonyl compound represented by undermentioned structural formula (I);

(I)

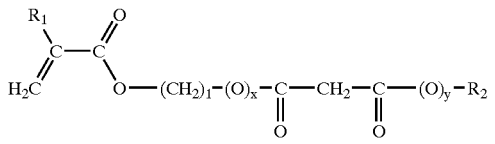

wherein an enol tautomeric form of the dicarbonyl compound is also included, and in formula (I), R1 is a hydrogen atom or a methyl group, R2 is a C2–10 alkenyl group having a double bond at the end thereof or a C1–10 alkyl group, l is 1 to 3, and x and y are each independently 0 or 1.

3. The water-based metal surface treatment agent according to claim 1, being a water-based metal surface treatment agent for aluminum or magnesium.

4. The water-based metal surface treatment agent according to claim 1, being a water-based metal surface treatment agent for pre-coated aluminum.

5. A metallic material, having been treated with the water-based metal surface treatment agent according to claim 1.

6. An aluminum material, having been treated with the water-based metal surface treatment agent according to claim 1.

7. A magnesium material, having been treated with the water-based metal surface treatment agent according to claim 1.

8. A pre-coated aluminum material, having been treated with the water-based metal surface treatment agent according to claim 1.

* * * * *